US008314752B2

(12) United States Patent
Huang et al.

(10) Patent No.: US 8,314,752 B2
(45) Date of Patent: Nov. 20, 2012

(54) DISPLAY DEVICE AND RELATED DRIVING METHOD USING LOW CAPACITY ROW BUFFER MEMORY

(75) Inventors: Hsiao-Ming Huang, Kao-Hsiung (TW); Chun-Lung Wang, Hsinchu County (TW); Yi-Lin Yeh, Taoyuan County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 1347 days.

(21) Appl. No.: 11/762,073

(22) Filed: Jun. 13, 2007

(65) Prior Publication Data

US 2008/0266207 A1 Oct. 30, 2008

(30) Foreign Application Priority Data

Apr. 27, 2007 (TW) ..... 96114882 A

(51) Int. Cl.
*G09G 5/00* (2006.01)

(52) U.S. Cl. ..... 345/3.2; 345/686

(58) Field of Classification Search ..... 345/560, 345/562–578, 686, 582, 98, 559
See application file for complete search history.

(56) References Cited

U.S. PATENT DOCUMENTS

| | | | | |
|---|---|---|---|---|
| 6,034,663 | A | 3/2000 | Killebrew, Jr. | |
| 2007/0070078 | A1 * | 3/2007 | Schilling et al. | 345/582 |
| 2007/0115238 | A1 * | 5/2007 | Eom et al. | 345/98 |
| 2007/0296729 | A1 * | 12/2007 | Du et al. | 345/559 |

FOREIGN PATENT DOCUMENTS

| | | |
|---|---|---|
| TW | 315453 | 9/1997 |
| TW | 200605013 | 2/2006 |

* cited by examiner

*Primary Examiner* — Quan-Zhen Wang
*Assistant Examiner* — Yuk Chow
(74) *Attorney, Agent, or Firm* — Winston Hsu; Scott Margo

(57) ABSTRACT

In a method for driving a display device, an address counter is used for generating a plurality of address variables corresponding to data of a scan line. Next, an address mapping circuit generates a first target address by data-mapping an address variable, and generates a second target address by data mapping data stored in an address look-up table memory. Subsequently, a row buffer memory accesses data corresponding to a first scan line based on the first target address, and accesses data corresponding to a second scan line based on the second target address.

13 Claims, 10 Drawing Sheets

| Scan line (y=0) | Address varible (x) | Input data | Output data | Address for accessing the row buffer memory | |
|---|---|---|---|---|---|
| First half | 0 | $D_0$ | - | ADD_f1 | 0 |
| | 1 | $D_1$ | - | | 1 |
| | 2 | $D_2$ | - | | 2 |
| | 3 | $D_3$ | - | | 3 |
| | 4 | $D_4$ | - | | 4 |
| | 5 | $D_5$ | - | | 5 |
| | 6 | $D_6$ | - | | 6 |
| | 7 | $D_7$ | - | | 7 |
| | 8 | $D_8$ | - | | 8 |
| | 9 | $D_9$ | - | | 9 |
| | 10 | $D_{10}$ | - | | 10 |
| | 11 | $D_{11}$ | - | | 11 |
| | 12 | $D_{12}$ | - | | 12 |
| | 13 | $D_{13}$ | - | | 13 |
| | 14 | $D_{14}$ | - | | 14 |
| | 15 | $D_{15}$ | - | | 15 |
| Second half | n | $D_n$ | $D_0$ | ADD_f2 | 0 |
| | n+1 | $D_{n+1}$ | $D_n$ | | 0 |
| | n+2 | $D_{n+2}$ | $D_1$ | | 1 |
| | n+3 | $D_{n+3}$ | $D_{n+1}$ | | 0 |
| | n+4 | $D_{n+4}$ | $D_2$ | | 2 |
| | n+5 | $D_{n+5}$ | $D_{n+2}$ | | 1 |
| | n+6 | $D_{n+6}$ | $D_3$ | | 3 |
| | n+7 | $D_{n+7}$ | $D_{n+3}$ | | 0 |
| | n+8 | $D_{n+8}$ | $D_4$ | | 4 |
| | n+9 | $D_{n+9}$ | $D_{n+4}$ | | 2 |
| | n+10 | $D_{n+10}$ | $D_5$ | | 5 |
| | n+11 | $D_{n+11}$ | $D_{n+5}$ | | 1 |
| | n+12 | $D_{n+12}$ | $D_6$ | | 6 |
| | n+13 | $D_{n+13}$ | $D_{n+6}$ | | 3 |
| | n+14 | $D_{n+14}$ | $D_7$ | | 7 |
| | n+15 | $D_{n+15}$ | $D_{n+7}$ | | 0 |

Fig. 7

| Scan line (y=0) | Address varible (x) | Input data | Output data | Address for accessing the row buffer memory | |
|---|---|---|---|---|---|
| First half | 0 | $D_0$ | $D_8$ | ADD_f3 | 8 |
| | 1 | $D_1$ | $D_{n+8}$ | | 4 |
| | 2 | $D_2$ | $D_9$ | | 9 |
| | 3 | $D_3$ | $D_{n+9}$ | | 2 |
| | 4 | $D_4$ | $D_{10}$ | | 10 |
| | 5 | $D_5$ | $D_{n+10}$ | | 5 |
| | 6 | $D_6$ | $D_{11}$ | | 11 |
| | 7 | $D_7$ | $D_{n+11}$ | | 1 |
| | 8 | $D_8$ | $D_{12}$ | | 12 |
| | 9 | $D_9$ | $D_{n+12}$ | | 6 |
| | 10 | $D_{10}$ | $D_{13}$ | | 13 |
| | 11 | $D_{11}$ | $D_{n+13}$ | | 3 |
| | 12 | $D_{12}$ | $D_{14}$ | | 14 |
| | 13 | $D_{13}$ | $D_{n+14}$ | | 7 |
| | 14 | $D_{14}$ | $D_{15}$ | | 15 |
| | 15 | $D_{15}$ | $D_{n+15}$ | | 0 |
| Second half | n | $D_n$ | $D_0$ | ADD_f4 | 8 |
| | n+1 | $D_{n+1}$ | $D_n$ | | 8 |
| | n+2 | $D_{n+2}$ | $D_1$ | | 4 |
| | n+3 | $D_{n+3}$ | $D_{n+1}$ | | 8 |
| | n+4 | $D_{n+4}$ | $D_2$ | | 9 |
| | n+5 | $D_{n+5}$ | $D_{n+2}$ | | 4 |
| | n+6 | $D_{n+6}$ | $D_3$ | | 2 |
| | n+7 | $D_{n+7}$ | $D_{n+3}$ | | 8 |
| | n+8 | $D_{n+8}$ | $D_4$ | | 10 |
| | n+9 | $D_{n+9}$ | $D_{n+4}$ | | 9 |
| | n+10 | $D_{n+10}$ | $D_5$ | | 5 |
| | n+11 | $D_{n+11}$ | $D_{n+5}$ | | 4 |
| | n+12 | $D_{n+12}$ | $D_6$ | | 11 |
| | n+13 | $D_{n+13}$ | $D_{n+6}$ | | 2 |
| | n+14 | $D_{n+14}$ | $D_7$ | | 1 |
| | n+15 | $D_{n+15}$ | $D_{n+7}$ | | 8 |

Fig. 8

| Scan line (y=0) | Address varible (x) | Input data | Output data | Address for accessing the row buffer memory | |
|---|---|---|---|---|---|
| First half | 0 | $D_0$ | - | ADD_r1 | 0 |
| | 1 | $D_1$ | - | | 1 |
| | 2 | $D_2$ | - | | 2 |
| | 3 | $D_3$ | - | | 3 |
| | 4 | $D_4$ | - | | 4 |
| | 5 | $D_5$ | - | | 5 |
| | 6 | $D_6$ | - | | 6 |
| | 7 | $D_7$ | - | | 7 |
| | 8 | $D_8$ | - | | 8 |
| | 9 | $D_9$ | - | | 9 |
| | 10 | $D_{10}$ | - | | 10 |
| | 11 | $D_{11}$ | - | | 11 |
| | 12 | $D_{12}$ | - | | 12 |
| | 13 | $D_{13}$ | - | | 13 |
| | 14 | $D_{14}$ | - | | 14 |
| | 15 | $D_{15}$ | - | | 15 |
| Second half | n | $D_n$ | $D_{15}$ | ADD_r2 | 15 |
| | n+1 | $D_{n+1}$ | $D_n$ | | 15 |
| | n+2 | $D_{n+2}$ | $D_{14}$ | | 14 |
| | n+3 | $D_{n+3}$ | $D_{n+1}$ | | 15 |
| | n+4 | $D_{n+4}$ | $D_{13}$ | | 13 |
| | n+5 | $D_{n+5}$ | $D_{n+2}$ | | 14 |
| | n+6 | $D_{n+6}$ | $D_{12}$ | | 12 |
| | n+7 | $D_{n+7}$ | $D_{n+3}$ | | 15 |
| | n+8 | $D_{n+8}$ | $D_{11}$ | | 11 |
| | n+9 | $D_{n+9}$ | $D_{n+4}$ | | 13 |
| | n+10 | $D_{n+10}$ | $D_{10}$ | | 10 |
| | n+11 | $D_{n+11}$ | $D_{n+5}$ | | 14 |
| | n+12 | $D_{n+12}$ | $D_9$ | | 9 |
| | n+13 | $D_{n+13}$ | $D_{n+6}$ | | 12 |
| | n+14 | $D_{n+14}$ | $D_8$ | | 8 |
| | n+15 | $D_{n+15}$ | $D_{n+7}$ | | 15 |

Fig. 9

| Scan line (y=0) | Address varible (x) | Input data | Output data | Address for accessing the row buffer memory | |
|---|---|---|---|---|---|
| First half | 0 | $D_0$ | $D_7$ | ADD_r3 | 7 |
| | 1 | $D_1$ | $D_{n+8}$ | | 11 |
| | 2 | $D_2$ | $D_6$ | | 6 |
| | 3 | $D_3$ | $D_{n+9}$ | | 13 |
| | 4 | $D_4$ | $D_5$ | | 5 |
| | 5 | $D_5$ | $D_{n+10}$ | | 10 |
| | 6 | $D_6$ | $D_4$ | | 4 |
| | 7 | $D_7$ | $D_{n+11}$ | | 14 |
| | 8 | $D_8$ | $D_3$ | | 3 |
| | 9 | $D_9$ | $D_{n+12}$ | | 9 |
| | 10 | $D_{10}$ | $D_2$ | | 2 |
| | 11 | $D_{11}$ | $D_{n+13}$ | | 12 |
| | 12 | $D_{12}$ | $D_1$ | | 1 |
| | 13 | $D_{13}$ | $D_{n+14}$ | | 8 |
| | 14 | $D_{14}$ | $D_0$ | | 0 |
| | 15 | $D_{15}$ | $D_{n+15}$ | | 15 |
| Second half | n | $D_n$ | $D_{15}$ | ADD_r4 | 15 |
| | n+1 | $D_{n+1}$ | $D_n$ | | 15 |
| | n+2 | $D_{n+2}$ | $D_{14}$ | | 0 |
| | n+3 | $D_{n+3}$ | $D_{n+1}$ | | 15 |
| | n+4 | $D_{n+4}$ | $D_{13}$ | | 8 |
| | n+5 | $D_{n+5}$ | $D_{n+2}$ | | 0 |
| | n+6 | $D_{n+6}$ | $D_{12}$ | | 1 |
| | n+7 | $D_{n+7}$ | $D_{n+3}$ | | 15 |
| | n+8 | $D_{n+8}$ | $D_{11}$ | | 12 |
| | n+9 | $D_{n+9}$ | $D_{n+4}$ | | 8 |
| | n+10 | $D_{n+10}$ | $D_{10}$ | | 2 |
| | n+11 | $D_{n+11}$ | $D_{n+5}$ | | 0 |
| | n+12 | $D_{n+12}$ | $D_9$ | | 9 |
| | n+13 | $D_{n+13}$ | $D_{n+6}$ | | 1 |
| | n+14 | $D_{n+14}$ | $D_8$ | | 3 |
| | n+15 | $D_{n+15}$ | $D_{n+7}$ | | 15 |

Fig. 10

DISPLAY DEVICE AND RELATED DRIVING METHOD USING LOW CAPACITY ROW BUFFER MEMORY

BACKGROUND OF THE INVENTION

1. Field of the Invention

The present invention relates to a display device and related driving method, and more particularly, to a display device and related driving method using a low capacity row buffer memory.

2. Description of the Prior Art

Due to advantages such as low radiation, thin appearance and low power consumption, liquid crystal display (LCD) devices have gradually replaced traditional cathode ray tube (CRT) displays and have been widely used in portable information products, such as notebook computers, personal digital assistants (PDA), flat panel televisions and mobile phones, etc.

Please refer to FIG. 1. FIG. 1 is a schematic diagram of a prior art LCD display device 10. The LCD display device 10 includes an LCD panel 12 and a timing controller 14. The LCD panel 12 includes a plurality of data lines $D_1$-$D_{2n}$ and a plurality of scan lines $G_1$-$G_m$, and is divided into a front port and a back port. The data lines $D_1$-$D_n$ are disposed on the front port of the LCD panel 12, while the data lines $D_{n+1}$-$D_{2n}$ are disposed on the back port of the LCD panel 12. Moreover, at each intersection of the data lines and the scan lines, a pixel unit (shown as a dot in FIG. 1) is installed for displaying images.

With increasing demands of large-size applications, the number of the data lines and the scan lines also increases. Thus, in order to drive the LCD panel 12 more efficiently, the timing controller 14 can generate driving signals respectively corresponding to the front port and the back port. The timing controller 14 includes a row buffer controller 16 and a row buffer memory 18. The row buffer controller 16 is utilized for receiving pixel input data $D_{IN}$. The pixel input data $D_{IN}$ includes odd-numbered pixel input data $D_{IN_ODD}$ and even-numbered pixel input data $D_{IN_EVEN}$, and is respectively stored at corresponding addresses of the row buffer memory 18. When outputting data to different pixels of a scan line, the row buffer controller 16 can read out the data stored at the corresponding addresses of the row buffer memory 18 to generate front port pixel output data $D_{OUT_FRONT}$ corresponding to the former half pixels of the scan line and back port pixel output data $D_{OUT_BACK}$ corresponding to the later half pixels of the scan line. Therefore, the timing controller 14 can output data to the pixel units of the scan line in sequence with a forward manner, that means, the front port pixel output data $D_{OUT_FRONT}$ is orderly outputted to the data line $D_1$-$D_n$, while the back port pixel output data $D_{OUT_BACK}$ is orderly outputted to the data line $D_{n+1}$-$D_{2n}$. A dashed arrow in FIG. 1 represents the order of the output data.

Please refer to FIG. 2. FIG. 2 is a schematic diagram of the prior art LCD display device 10 when outputting data in the forward manner. Assuming that the LCD panel 12 includes 1280 data lines, i.e. each scan line includes 1280 pixel units, the pixel input data $D_{IN}$ thus includes data $D_1$-$D_{1280}$, among which the odd-numbered pixel input data $D_{IN_ODD}$ includes the data $D_1$, $D_3$ . . . $D_{1279}$ and the even-numbered pixel input data $D_{IN_EVEN}$ includes the data $D_2$, $D_4$ . . . $D_{1280}$. Meanwhile, the front port pixel output data $D_{OUT_FRONT}$ includes the data $D_1$-$D_{640}$, and the back port pixel output data $D_{OUT_BACK}$ includes the data $D_{641}$-$D_{1280}$. At first, the prior art LCD display device 10 reads in the data $D_1$-$D_{1280}$ to corresponding addresses of the row buffer memory 18 in order. When outputting data in the forward manner, after the last data $D_{640}$ of the front port pixel output data $D_{OUT_FRONT}$ is read in, the first data $D_{641}$ of the back port pixel output data $D_{OUT_BACK}$ is then read in. At this time, the timing controller 14 can output the data to the LCD panel 12 with the order $D_1$-$D_{641}$-$D_2$-$D_{642}$- . . . -$D_{640}$-$D_{1280}$.

Please refer to FIG. 3. FIG. 3 is a schematic diagram of a prior art LCD display device 30. The LCD display device 30 includes an LCD panel 32 and a timing controller 34. The LCD panel 32 includes a plurality of data lines $D_1$-$D_{2n}$ and a plurality of scan lines $G_1$-$G_m$, and is divided into a front port and a back port. The data lines $D_1$-$D_n$ are disposed on the front port of the LCD panel 32, while the data lines $D_{n+1}$-$D_{2n}$ are disposed on the back port of the LCD panel 32. Moreover, at each intersection of the data lines and the scan lines, a pixel unit (shown as a dot in FIG. 3) is installed for displaying images. The timing controller 34 includes a row buffer controller 36 and a row buffer memory 38. Compared with the LCD display device 10 outputting data with the forward manner, the LCD display device 30 can output data to pixel units of a scan line in sequence with a backward manner, that means, the front port pixel output data $D_{OUT_FRONT}$ is orderly outputted to the data lines $D_n$-$D_1$, and the back port pixel output data $D_{OUT_BACK}$ is orderly outputted to the data lines $D_{n+1}$-$D_{2n}$. A dashed arrow in FIG. 3 represents the order of the output data.

Please refer to FIG. 4. FIG. 4 is a schematic diagram of the prior art LCD display device 30 when outputting data in the backward manner. Assuming that the LCD panel 32 includes 1280 data lines, i.e. each scan line includes 1280 pixel units, the pixel input data $D_{IN}$ thus includes data $D_1$-$D_{1280}$, among which the odd-numbered pixel input data $D_{IN_ODD}$ includes the data $D_1$, $D_3$ . . . $D_{1279}$ and the even-numbered pixel input data $D_{IN_EVEN}$ includes $D_2$, $D_4$ . . . $D_{1280}$. Meanwhile, the front port pixel output data $D_{OUT_FRONT}$ includes the data $D_1$-$D_{640}$, and the back port pixel output data $D_{OUT_BACK}$ includes the data $D_{641}$-$D_{1280}$. At first, the prior art LCD display device 30 reads in the data $D_1$-$D_{1280}$ to corresponding addresses of the row buffer memory 38 in order. When outputting data in the backward manner, after the last data $D_{640}$ of the front port pixel output data $D_{OUT_FRONT}$ is read in, the first data $D_{641}$ of the back port pixel output data $D_{OUT_BACK}$ is then read in. At this time, the timing controller 34 can output the data to the LCD panel 32 with the order $D_{640}$-$D_{641}$-$D_{639}$-$D_{642}$- . . . -$D_1$-$D_{1280}$. Since when outputting the front port pixel output data, the data that is read in much earlier is outputted much later, so that the row buffer memory 38 with a large capacity needs to be used for the prior art LCD display device 30.

SUMMARY OF THE INVENTION

It is therefore a primary objective of the present invention to provide a display device and related driving method using a low capacity row buffer memory.

The present invention discloses a method for driving a display device. The method includes an address counter generating a plurality of address variables according to data of a scan line of a plurality of scan lines on a display panel. An address mapping circuit address maps the address variable generated by the address counter to generate a corresponding first target address. The address mapping circuit also address maps data stored in an address look-up table memory according to the address variables generated by the address counter to generate a corresponding second target address. A row buffer memory accesses data corresponding to a first scan line of the plurality of scan lines according to the first target address and the row buffer memory accesses data corresponding to a second scan line of the plurality of scan lines according to the second target address. The row buffer memory also accesses data corresponding to the first scan line according to the address variables generated by the address counter and the row buffer memory accesses data corresponding to the second scan line according to data stored in the address look-up table memory.

The present invention further discloses a display device using a low capacity row buffer memory. The display device includes a display panel having a plurality of scan lines. A timing controller includes an address counter for generating a corresponding address variable according to data of a scan line. An address look-up table memory is included for storing look-up table data. An address mapping circuit for address mapping the address variable to generates a corresponding first target address, and generates a corresponding second target address according to the address variable and the look-up table data stored in the address look-up table memory. A row buffer memory is utilized for storing the first target address, the second target address and the address variable.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 7 illustrates relation between the address variable generated by the address counter and addresses of input/output data stored in the row buffer memory when driving the first scan line in the forward manner.

FIG. 8 illustrates relation between the address variable x generated by the address counter and addresses of input/output data stored in the row buffer memory when driving the other scan line in the forward manner.

FIG. 9 illustrates relation between the address variable x generated by the address counter and addresses of input/output data stored in the row buffer memory when driving the first scan line in the backward manner.

FIG. 10 illustrates relation between the address variable x generated by the address counter and addresses of input/output data stored in the row buffer memory when driving the other scan line in the backward manner.

DETAILED DESCRIPTION

Figure 1:
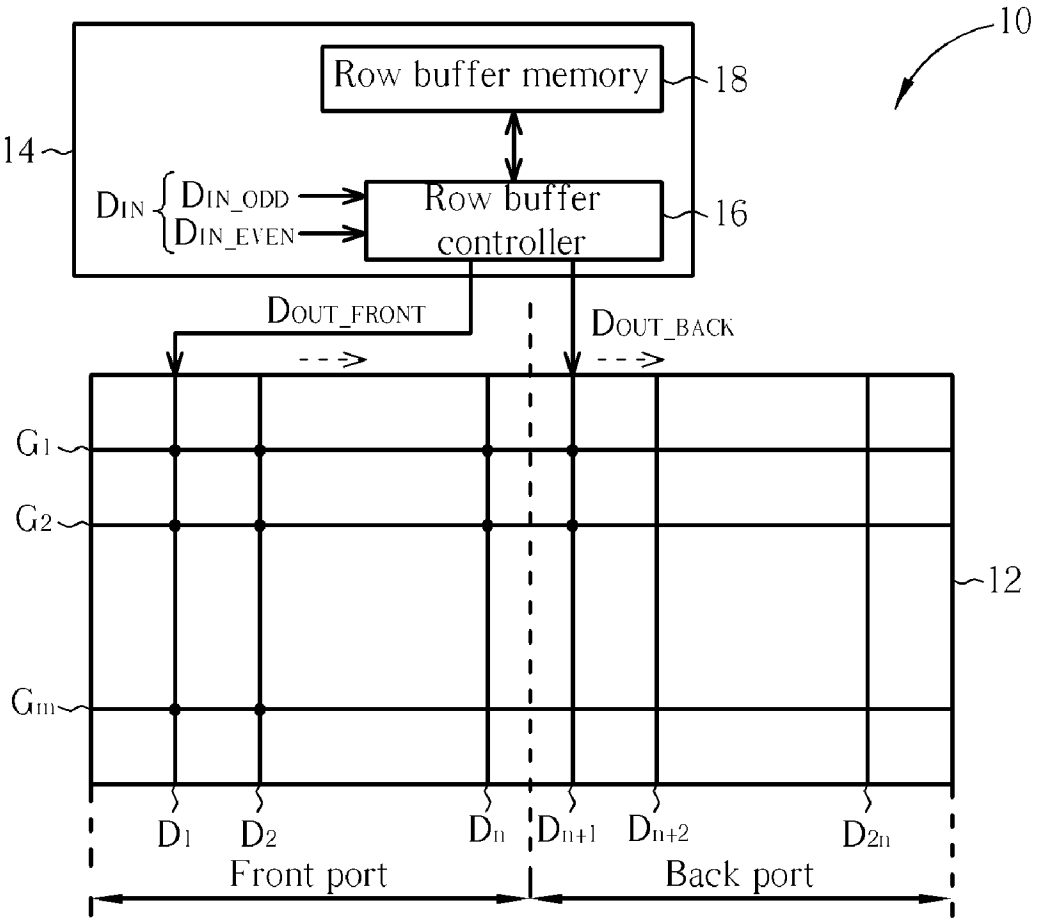
Fig. 1 Prior Art
FIG. 1 is a schematic diagram of a prior art LCD display device.
Figure 2:
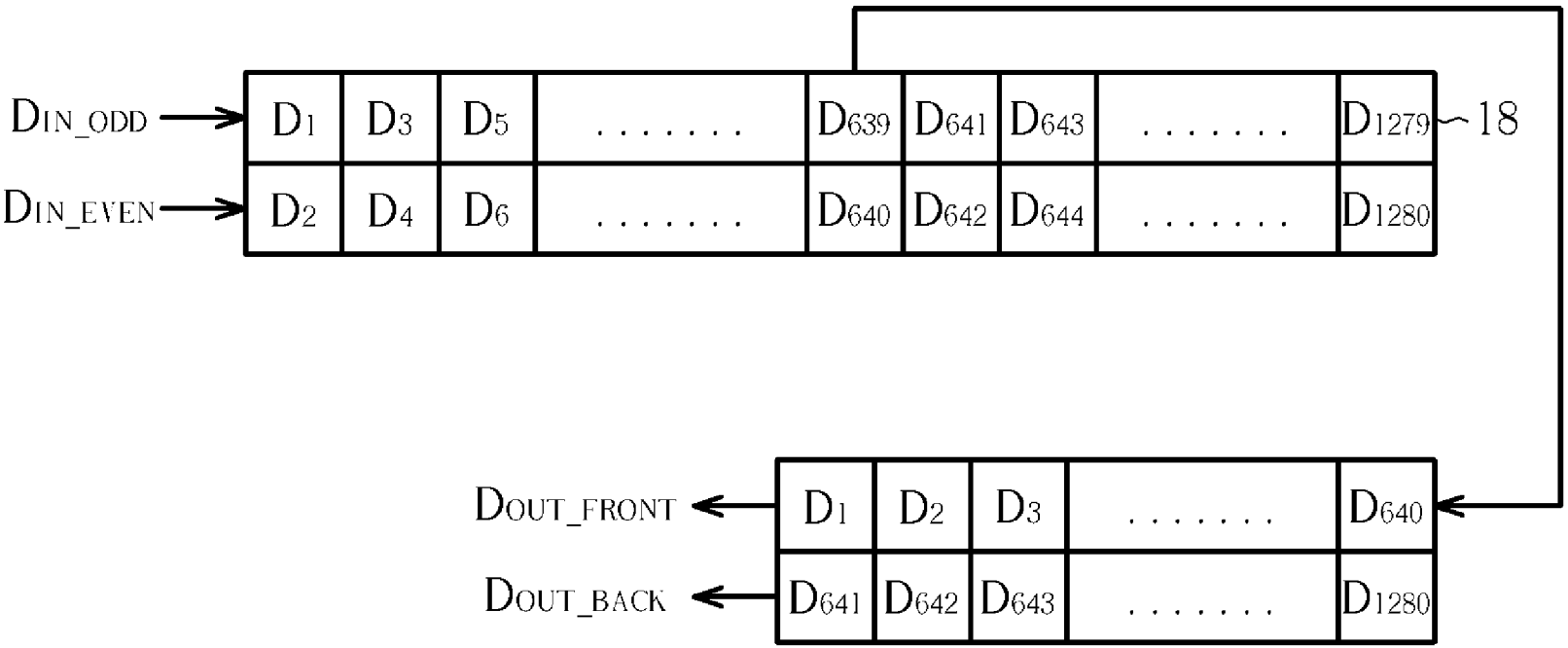
Fig. 2 Prior Art
FIG. 2 is a schematic diagram of the prior art LCD display device when outputting data in the forward manner.
Figure 3:
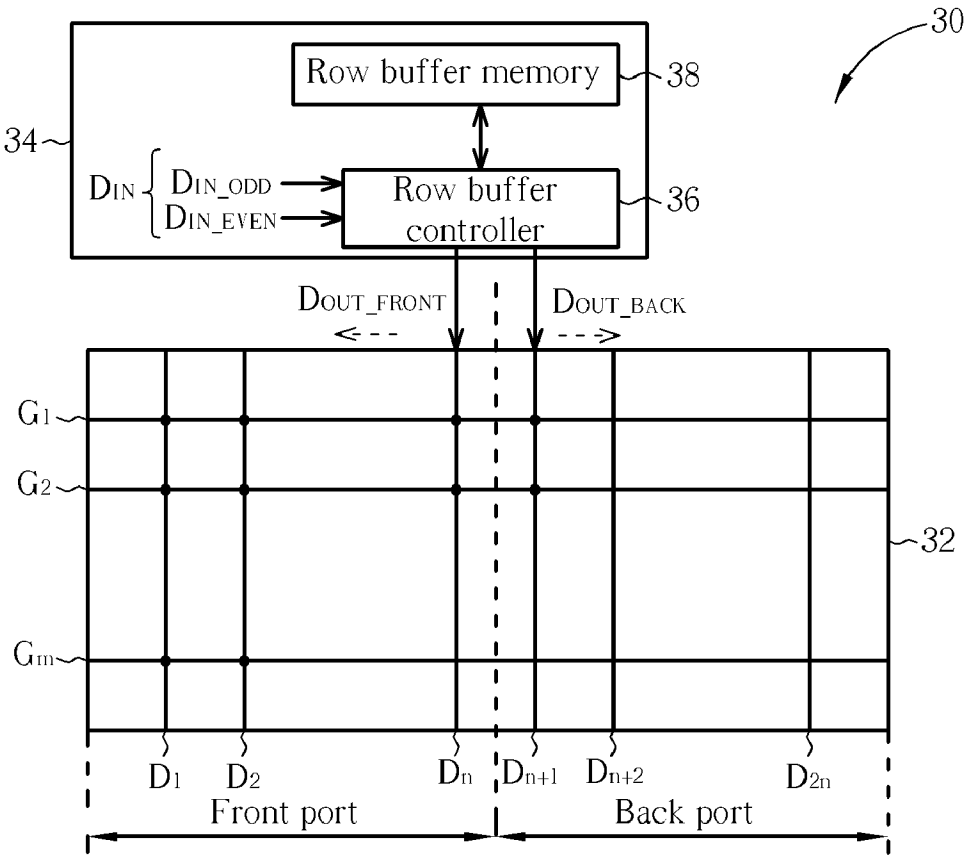
Fig. 3 Prior Art
FIG. 3 is a schematic diagram of a prior art LCD display device.
Figure 4:
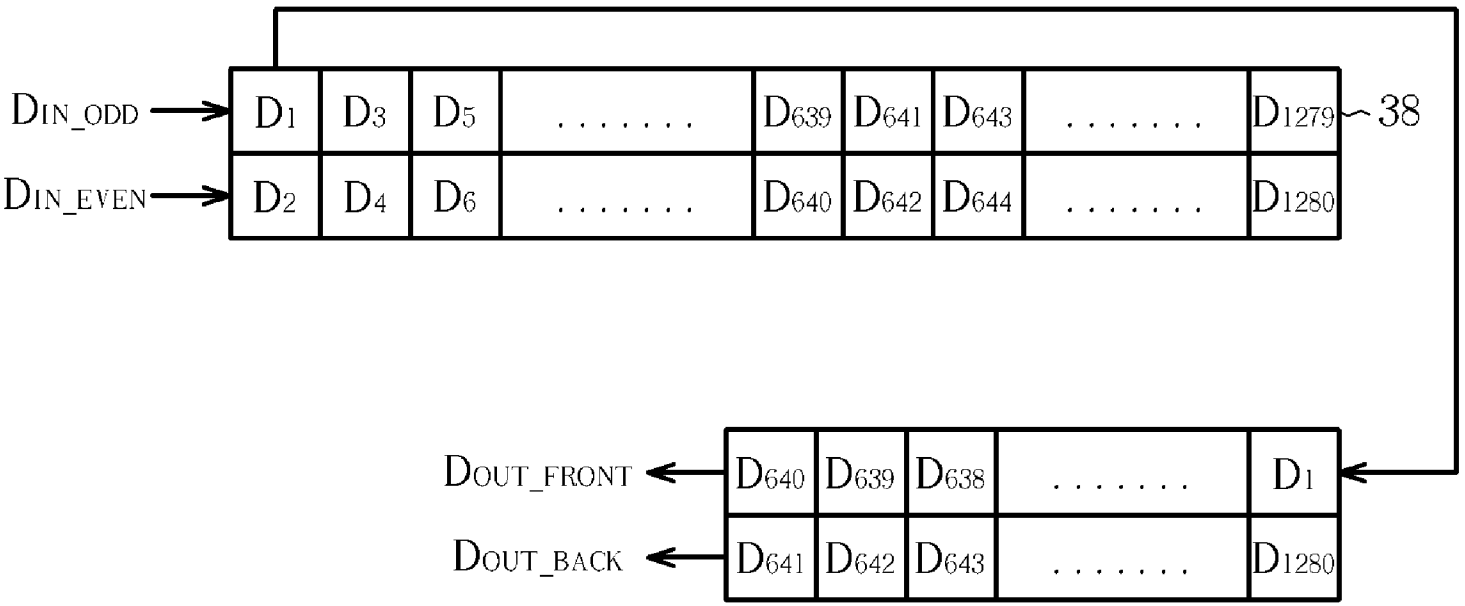
Fig. 4 Prior Art
FIG. 4 is a schematic diagram of the prior art LCD display device when outputting data in the backward manner.
Figure 5:
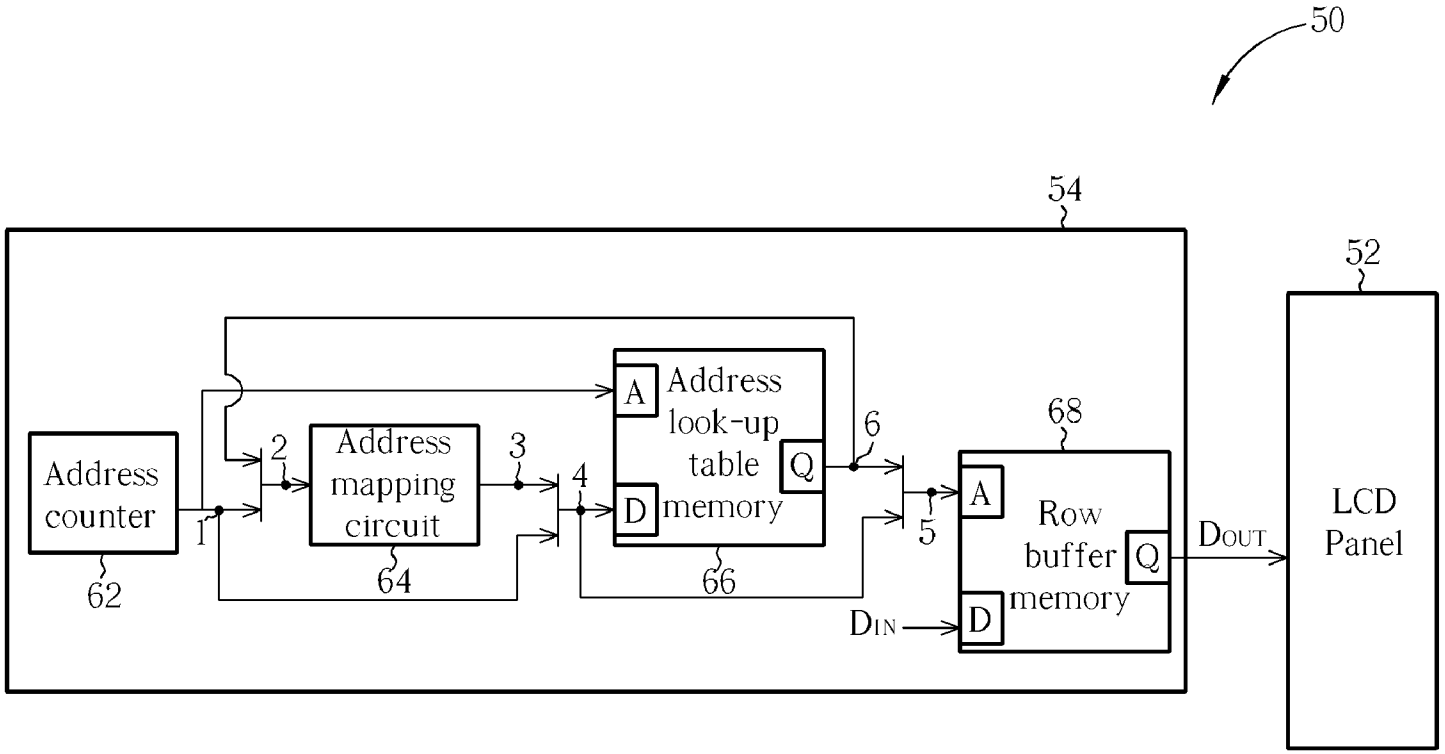
FIG. 5 is a schematic diagram of an LCD display device of the present invention.

Please refer to FIG. 5. FIG. 5 is a schematic diagram of an LCD display device 50 of the present invention. The LCD display device 50 includes an LCD panel 52 and a timing controller 54. The timing controller 54 includes an address counter 62, an address mapping circuit 64, an address look-up table memory 66 and a row buffer memory 68. The address counter 62 can generate a corresponding address variable x according to the number of pixels included in a scan line of a plurality of scan lines. The address mapping circuit 64 can perform address mapping for the address variable x. The address look-up table memory 66 can receive and store the address variable x generated by the address counter 62 at a terminal A, can receive and store output data of the address mapping circuit 64 at a terminal D, and can generate output data LUT(x, y) at a terminal Q. The row buffer memory 68 can receive input data $D_{IN}$ corresponding to display images at a terminal D, can store the input data $D_{IN}$ according to signals received by a terminal A, and can generate output data $D_{OUT}$ to the LCD panel 52 at a terminal Q. Node 1-6 in FIG. 5 are utilized for defining data transmission path of the LCD display device 50 in different operational states, and the details will be discussed in the following.

Figure 6:
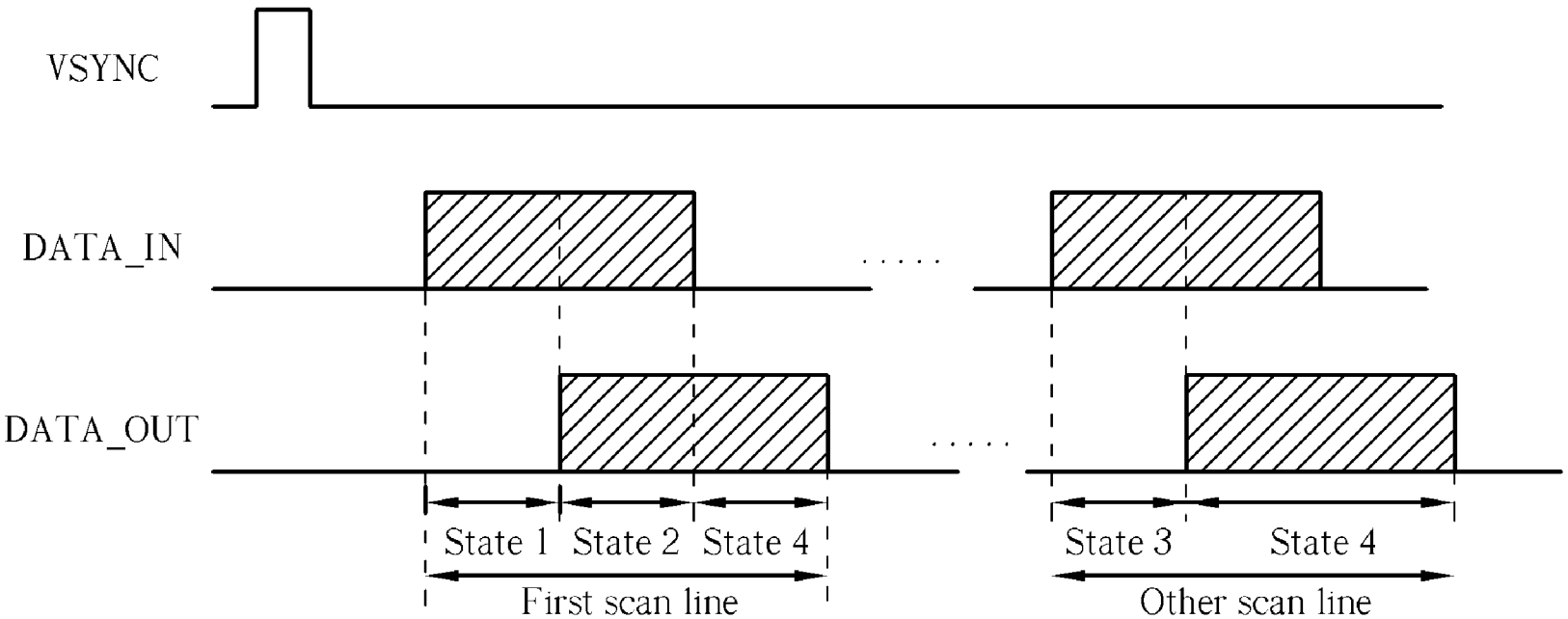
FIG. 6 is a schematic diagram of signals of the present invention LCD display device when in operation.

Please refer to FIG. 6. FIG. 6 is a schematic diagram of signals of the present invention LCD display device 50 when in operation. In FIG. 6, VSYNC, DATA_IN and DATA_OUT respectively represent waveforms of a horizontal synchronization signal, the input data $D_{IN}$ and the output data $D_{OUT}$. The LCD display device 50 includes four operation states: state 1 represents a first half of input data of a first scan line (the first scan line after the horizontal synchronization signal VSYNC is triggered); state 2 represents a later half of input data of the first scan line, and also represents a first half of output data of the first scan line simultaneously; state 3 represents a first half of input data of an other scan line; and state 4 represents an other state of input data and output data of the other scan line.

When the LCD display device 50 is operated in state 1, the data transmission path in FIG. 5 is node 1→node 4→node 5. At this time, the address variable x is not performed as address mapping, but is directly transmitted to the A terminal of the row buffer memory 68 as a target address for accessing the row buffer memory 68. Meanwhile, the address variable x is also stored into the address look-up table memory 66 through the A terminal of the address look-up table memory 66.

When the LCD display device 50 is operated in state 2, the data transmission path in FIG. 5 is node 1→node 2→node 3→node 4→node 5. At first, the address mapping circuit 64 performs address mapping for the address variable x to generate a corresponding target address, and then the corresponding target address is transmitted to the A terminal of the row buffer memory 68 for reading out the data accordingly. Meanwhile, the target address is stored into the address look-up table memory 66 through the D terminal of the address look-up table memory 66.

When the LCD display device 50 is operated in state 3, the data transmission path in FIG. 5 is node 6→node 5. In this case, instead of performing address mapping, the data LUT(x, y) stored in the address look-up table memory 66 is directly read out as a target address for accessing the row buffer memory 68, wherein x represents the address variable generated by the address counter 62 and y represents the scan line.

When the LCD display device 50 is operated in state 4, the data transmission path in FIG. 5 is node 6→node 2→node 3→node 4→node 5. Firstly reading out the data LUT(x, y) stored in the address look-up table memory 66, the address mapping circuit 64 then performs address mapping for the data LUT(x, y) to generate a corresponding target address. After that, the target address is transmitted to the A terminal of the row buffer memory 68 for reading out the data accordingly. Meanwhile, the target address is stored into the address look-up table memory 66 through the D terminal of the address look-up table memory 66.

Next, the manner that the address mapping circuit 64 of the present invention performs address mapping is illustrated. Assuming that a scan line can display 2n bytes, and since I byte includes 4 pixels, a scan line thus includes 8n pixels. Please refer to FIG. 7 and FIG. 8. FIG. 7 illustrates the relation between the address variable x generated by the address counter 62 and addresses of input/output data stored in the row buffer memory 68 when driving the first scan line (y=0) in the forward manner, while FIG. 8 illustrates the relation between the address variable x generated by the address counter 62 and addresses of input/output data stored in the row buffer memory 68 when driving the other scan line (such as: y=1) in the forward manner. If a scan line includes 8n pixels, data displayed by the scan line includes n front port data $D_0$~$D_{n-1}$ and n back port data $D_n$~$D_{2n-1}$, which respectively corresponds to the 2n bytes. To simplify matters, the embodiments shown in FIG. 7 and FIG. 8 takes n=16 for example. The address counter 62 of the present invention can be an incremental counter, and can generate a corresponding address variable x according to each read-in data respectively. If driving the first scan line in the forward manner, when the data $D_0$~$D_{n+15}$ is in order read in to addresses 0-($n$+15) of the row buffer memory 68, the value of the corresponding address variable x also increases from 0 to (n+15) respectively. Meanwhile, the data with the order $D_0$-$D_n$-$D_1$-$D_{n+1}$- . . . -$D_{15}$-$D_{n+15}$ is outputted to the LCD panel 52. When the address variable x equals n (x=n), the first output data $D_0$ can be read out from the address 0 of the row buffer memory 68, and thus the address 0 can be used for storing the next read-in data $D_n$; when the address variable x equals n+1 (x=n+1), the next output data $D_n$ can be read out from the address 0 of the row buffer memory 68, and thus the address 0 can then be used for storing a next read-in data $D_{n+1}$; when the address variable x equals n+2 (x=n+2), the next output data $D_1$ can be read out from the address 1 of the row buffer memory 68, and thus the address 1 can be used for storing the next read-in data $D_{n+2}$; when the address variable x equals n+3 (x=n+3), the next output data $D_{n+1}$ can be read out from the address 0 of the row buffer memory 68, and thus the address 0 can then be used for storing the next read-in data $D_{n+3}$. The rest are all completed in like manners.

As shown in the second half of FIG. 7, for the even-numbered back port data ($D_n$, $D_{n+2}$ . . . $D_{n+14}$) of the back port data of the first scan line, the address for reading in the $(n+2s)^{th}$ byte and the address for reading out the $s^{th}$ byte are the same, and that is:

$$LUT(n+2s,y)=LUT(s,y),\ 0\leqq s<(n/2) \qquad \text{Formula 1}$$

Similarly, for the odd-numbered back port data ($D_{n+1}$, $D_{n+3}$ . . . $D_{2n+1}$) of the back port data of the first scan line, the address for reading in the $(n+2s+1)^{th}$ byte and the address for reading out the $(n+s)^{th}$ byte are the same, and that is:

$$LUT(n+2s+1,y)=LUT(n+s,y),\ 0\leqq s<(n/2) \qquad \text{Formula 2}$$

If setting s as 2t, Formula 2 and Formula 1 can be merged as follows:

$$LUT(n+4t+1,y)=LUT(n+2t,y)=LUT(t,y),\ 0\leqq t<(n/4) \qquad \text{Formula 3}$$

If setting s as 4u+1, Formula 2 and Formula 3 can be merged as follows:

$$LUT(n+8u+3,y)=LUT(n+4u+1,y)=LUT(u,y),\ 0\leqq u<(n/8) \qquad \text{Formula 4}$$

If setting s as 8v+3, Formula 2 and Formula 4 can be merged as follows:

$$LUT(n+16v+7,y)=LUT(n+8v+3,y)=LUT(v,y),\ 0\leqq v<(n/16) \qquad \text{Formula 5}$$

As 0≦x<n, from Formula 1, Formula 3, Formula 4 and Formula 5, a Formula 6 can be obtained:

$$LUT(n+x,y)=LUT(h(x),y) \qquad \text{Formula 6}$$

When n is equal to 16 (n=16), the address variable x represented in binary form at most includes 4 bits, and thus the function h(x) can be expressed by Verilog, a hardware description language (HDL), as follows:

```
case(x)
'b???1:h(x)=(x>>1);
Discriminant 1
'b??01:h(x)=(x>>2);
Discriminant 2
'b?011:h(x)=(x>>3);
Discriminant 3
'b?111:h(x)=(x>>4);
Discriminant 4
endcase
```

wherein "'b" represents the address variable x expressed in binary form, "?" represents arbitrary bits, and ">>" represents right shifting. Discriminant 1 to Discriminant 4 respectively corresponds to Formula 1, Formula 3, Formula 4 and Formula 5. Simply speaking, when the least significant bit of the address variable x is 1, the value of the function h(x) is equal to the value that x is right shifted one bit as Formula 1 and Discriminant 1 indicate; when the last two bits of the address variable x are "01", the value of the function h(x) is equal to the value that x is right shifted two bits as Formula 3 and Discriminant 2 indicate; when the last three bits of the address variable x is "011", the value of the function h(x) is equal to the value that x is right shifted three bits as Formula 4 and Discriminant 3 indicate; and when the address variable x is equal to "0111", the value of the function h(x) is equal to the value that x is right shifted four bits as Formula 5 and Discriminant 4 indicates.

When n is equal to other values, the address variable x represented in binary form may includes more bits, and thus the function h(x) can be generalized as:

```
while x[0]=1
x=x>>1;
h(x)=x>>1;
```

wherein x[0] represents the least significant bit of the address variable x expressed in binary form. Simply speaking, when the least significant bit of the address variable x is equal to 1, the address variable x is right shifted until the least significant bit is no longer equal to 1, and the value of the function h(x) is then equal to the value that the right-shifted address variable x if right shifted one bit further; on the other hand, when the least significant bit of the address variable x is not equal to 1, the value of the function h(x) is equal to the value that the address variable x if right shifted one bit.

As n≦x<2n, form Formula 6, a Formula 7 can be obtained:

$$LUT(n+x,y)=LUT(h(x),y) \qquad \text{Formula 7}$$

As shown in the first half of FIG. 8, for the even-numbered front port data ($D_0$, $D_2$ . . . $D_{14}$) of the front port data of an other scan line (such as: y=1), the address for reading in the $2s^{th}$ byte of the $y^{th}$ scan line is the same as the address for reading out the $(n/2+s)^{th}$ byte of the $(y-1)^{th}$ scan line, and thus:

$$LUT(2s,y)=LUT(n/2+s,y-1),\ 0\leqq s<(n/2) \qquad \text{Formula 8}$$

Similarly, for the odd-numbered front port data (D1, D3 . . . D15) of the front port data of the other scan line (such as: y=1), the address for reading in the $(2s+1)^{th}$ byte of the $y^{th}$ scan line is the same as the address for reading out the $(n/2+s)^{th}$ byte of the $(y-1)^{th}$ scan line, and thus:

$$LUT(2s+1,y)=LUT(n/2+s,y-1),\ 0\leqq s<(n/2) \qquad \text{Formula 9}$$

From Formula 9 and Formula 6, a Formula 10 can be obtained as follows:

$$LUT(2s+1,y)=LUT(h(n/2+s),y-1) \quad \text{Formula 10}$$

For the front port data of a scan line, $0 \leqq x<n$, and thus a Formula 11 can be obtained from Formula 8 and Formula 10 as follows:

$$LUT(x,y)=LUT(f(x),y-1) \quad \text{Formula 11}$$

The function f(x) can be expressed by Verilog HDL as:

```
case(x)
'b???0:f(x)=((n+x)>>1);
Discriminant 5
'b??01:f(x)=h((n+x)>>1);
Discriminant 6
endcase
```

The function h in Discriminant 6 can be expanded as:

```
case(x)
'b???0:f(x)=((n+x)>>1);
Discriminant 7
'b??01:f(x)=((n+x)>>2);
Discriminant 8
'b?011:f(x)=((n+x)>>3);
Discriminant 9
'b?111:f(x)=((n+x)>>4);
Discriminant 10
endcase
```

The form of Discriminant 7-Discriminant 10 corresponding to the function f(x) is similar to that of Discriminant 1-Discriminant 4 corresponding to the function h(x), and thus the function f(x) can be represented as follows:

$$f(x)=h(n+x) \quad \text{Formula 12}$$

As shown in the first half of FIG. 7, for the front port data ($D_0$~$D_{15}$) of the first scan line (y=0), there are no initial values in the address look-up table memory 66. In this case, the LCD display device 50 is operated in state 1, and the address calculation path is node 1→node 4→node 5. Thus, the address variable x is not performed as address mapping, but is directly utilized as a target address ADD_f1 for accessing the row buffer memory 68. The target address ADD_f1 is shown as follows:

$$ADD_f1=LUT(x,0)=x,\ 0 \leqq x<n \quad \text{Formula 13}$$

As shown in the second half of FIG. 7, for the back port data ($D_n$~$D_{n+15}$) of the first scan line (y=0), the LCD display device 50 is operated in state 2 and the address calculation path is node 1→node 2→node 3→node 4→node 5. In this case, the address mapping circuit 64 performs address mapping for the address variable x to generate a corresponding target address ADD_f2. The target address ADD_f2 can be obtained from Formula 7 and Formula 13 as:

$$ADD_f2=LUT(h(x-n),0)=h(x-n),\ n \leqq x<2n \quad \text{Formula 14}$$

As shown in the first half of FIG. 8, for the front port data ($D_0$~$D_{15}$) of an other scan line (such as: y=1), the LCD display device 50 is operated in state 3 and the address calculation path is node 6—node 5. In this case, instead of performing address mapping, the data LUT(x, y) stored in the address look-up table memory 66 is directly read in as a target address ADD_f3 for accessing the row buffer memory 68. The target address ADD_f3 is shown as follows:

$$ADD_f3=LUT(x,y),\ 0 \leqq x<n \quad \text{Formula 15}$$

As shown in the second half of FIG. 8, for the back port data ($D_n$~$D_{n+15}$) of the other scan line (such as: y=1), the LCD display device 50 is operated in state 4 and the address calculation path is node 6→node 2→node 3→node 4→node 5. In this case, the data LUT(x, y) stored in the address look-up table memory 66 is firstly read out, and then the address mapping circuit 64 performs address mapping for the data LUT(x, y) to generate a corresponding target address ADD_f4. The target address ADD_f4 can be derived in the following:

If $0 \leqq x<n$, from Formula 11 and Formula 13, a Formula 16 can be obtained as:

$$LUT(x,y)=LUT(f(x),y-1)=LUT(f2(x),y-2)=\ldots=LUT(fy(x),0)=fy(x) \quad \text{Formula 16}$$

That is:

$$LUT(x,1)=f(x)=f(LUT(x,0))$$

$$LUT(x,2)=f2(x)=f(f(x))=f(LUT(x,1))$$

$$\ldots$$

$$LUT(x,y)=fn(x)=f(LUT(x,y-1) \quad \text{Formula 17}$$

If $n \leqq x<2n$, from Formula 7 and Formula 16, a Formula 18 can be obtained as:

$$LUT(x,y)=LUT(h(x-n),y)=LUT(f(h(x-n)),y-1)=LUT(fy(h(x-n)),0)=fy(h(x-n)) \quad \text{Formula 18}$$

Therefore, when the LCD display device 50 is operated in state 4, the target address ADD_f4 can be obtained from Formula 12, Formula 16 and Formula 18, and can be expressed as:

$$ADD_f4=LUT(x,y)=f(LUT(h(x,y-1))=h(LUT(x,y-1)+n),\ n \leqq x<2n \quad \text{Formula 19}$$

Please refer to FIG. 9 and FIG. 10. FIG. 9 illustrates a relation between the address variable x generated by the address counter 62 and addresses of the input/output data stored in the row buffer memory 68 when driving the first scan line (y=0) in the backward manner; and FIG. 10 illustrates a relation between the address variable x generated by the address counter 62 and addresses of the input/output data stored in the row buffer memory 68 when driving the other scan line (such as: y=1) in the backward manner. If a scan line includes 8n pixels, data displayed by the scan line includes n front port data $D_0$-$D_{n-1}$ and n back port data $D_n$-$D_{2n-1}$, which respectively corresponds to the 2n bytes. To simplify matters, the embodiments shown in FIG. 9 and FIG. 10 take n=16 for example. If driving the first scan line in the backward manner, when the data $D_0$-$D_{n+15}$ is in order read in to addresses 0-($n$+15) of the row buffer memory 68, the value of the corresponding address variable x also increases from 0 to (n+15) respectively. Meanwhile, the data is outputted to the LCD panel 52 with the order $D_{15}$-$D_n$-$D_{14}$-$D_{n+1}$- . . . -$D_0$-$D_{n+15}$. When the address variable x equals n (x=n), the first output data $D_{15}$ can be read out from the address 15 of the row buffer memory 68, and thus the address 15 can be used for storing the next read-in data $D_n$; when the address variable x equals n+1 (x=n+1), the next output data $D_n$ can be read out from the address 15 of the row buffer memory 68, and thus the address 15 can then be used for storing the next read-in data $D_{n+1}$; when the address variable x equals n+2 (x=n+2), a next output data $D_{14}$ can be read out from the address 14 of the row buffer memory 68, and thus the address 14 can be used for storing the next read-in data $D_{n+2}$; when the address variable x equals n+3 (x=n+3), the next output data $D_{n+1}$ can be read out form the address 15 of the row buffer memory 68, and thus the address 15 can then be used for storing the next read-in data $D_{n+3}$. The rest are all completed in like manners.

As shown in the second half of FIG. 9, for the even-numbered back port data ($D_n$, $D_{n+2}$ . . . $D_{n+14}$) of the back port data of the first scan line, the address for reading in the $(n+2s)^{th}$ byte and the address for reading out the $(n-s-1)^{th}$ byte are the same:

$$LUT(n+2s,y)=LUT((n-1)-s,y),\ 0\leqq s<(n/2) \qquad \text{Formula 20}$$

Similarly, for the odd-numbered back port data ($D_{n+1}$, $D_{n+3}$ . . . $D_{2n+1}$) of the back port data of the first scan line, the address for reading in the $(n+2s+1)^{th}$ byte and the address for reading out the $(n+s)^{th}$ byte are the same:

$$LUT(n+2s+1,y)=LUT(n+s,y),\ 0\leqq s<(n/2) \qquad \text{Formula 21}$$

According to a derivation process of Formula 1 to Formula 6, a Formula 22 can be obtained from Formula 20 and Formula 21 as:

$$LUT(n+x,y)=LUT((n-1)-h(x),y),\ 0\leqq s<(n/2) \qquad \text{Formula 22}$$

As shown in the first half of FIG. 10, for the even-numbered front port data ($D_0$, $D_2$ . . . $D_{14}$) of the front port data of an other scan line (such as: y=1), the address for reading in the $2s^{th}$ byte of the $y^{th}$ scan line is the same as the address for reading out the $(n/2-s-1)^{th}$ byte of the $(y-1)^{th}$ scan line, and thus a Formula 23 can be obtained as:

$$LUT(2s,y)=LUT((n-1)-h(n/2+s),y-1),\ 0\leqq s<(n/2) \qquad \text{Formula 23}$$

Similarly, for the odd-numbered front port data ($D_1$, $D_3$ . . . $D_{15}$) of the front port data of the other scan line (such as: y=1), the address for reading in the $(2s+1)^{th}$ byte of the $y^{th}$ scan line is the same as the address for reading out the $(n/2+s)^{th}$ byte of the $(y-1)^{th}$ scan line, and thus a Formula 24 can be obtained as:

$$LUT(2s+1,y)=LUT(n/2+s,y-1),\ 0\leqq s<(n/2) \qquad \text{Formula 24}$$

From Formula 22 and Formula 24, a Formula 25 can be obtained as:

$$LUT(2s+1,y)=LUT(n/2+s,y-1)=LUT((n-1)-h(n/2+s),\ y-1) \qquad \text{Formula 25}$$

From Formula 23 and Formula 25, a Formula 26 can be obtained as:

$$LUT(x,y)=LUT((n-1)-f(x),y-1) \qquad \text{Formula 26}$$

Denoting Formula 22 and Formula 26 with the functions H(x) and F(x) as:

$$LUT(n+x,y)=LUT(H(x),y) \qquad \text{Formula 27}$$

$$LUT(x,y)=LUT(F(x),y-1) \qquad \text{Formula 28}$$

wherein H(x)=(n−1)−h(x), and F(x)=(n−1)−f(x)

From Formula 12, we can obtain:

$$F(x)=H(n+x)$$

As shown in the first half of FIG. 9, for the front port data ($D_0$-$D_{15}$) of the first scan line (y=0), there are no initial values in the address look-up table memory 66. In this case, the LCD display device 50 is operated in state 1, and the address calculation path is node 1→node 4→node 5. Thus, the address variable x is not performed address mapping, but is directly utilized as a target address ADD_r1 for accessing the row buffer memory 68. The target address ADD_r1 is shown as follows:

$$ADD_r1=LUT(x,0)=x,\ 0\leqq x<n \qquad \text{Formula 29}$$

As shown in the second half of FIG. 9, for the back port data ($D_n$-$D_{n+15}$) of the first scan line (y=0), the LCD display device 50 is operated in state 2 and the address calculation path is node 1→node 2→node 3→node 4→node 5. In this case, the address mapping circuit 64 performs address mapping for the address variable x to generate a corresponding target address ADD_r2. The target address ADD_r2 can be obtained from Formula 22 and Formula 27 as:

$$ADD_r2=LUT(x,0)=H(x-n)=(n-1)-h(x-n),\ n\leqq x<2n \qquad \text{Formula 30}$$

As shown in the first half of FIG. 10, for the front port data ($D_0$-$D_{15}$) of an other scan line (such as: y=1), the LCD display device 50 is operated in state 3 and the address calculation path is node 6→node 5. In this case, instead of performing address mapping, the data LUT(x, y) stored in the address look-up table memory 66 is directly read in as a target address ADD_r3 for accessing the row buffer memory 68. The target address ADD_r3 is shown as follows:

$$ADD_r3=LUT(x,y),\ 0\leqq x<n \qquad \text{Formula 31}$$

As shown in the second half of FIG. 10, for the back port data ($D_n$-$D_{n+15}$) of the other scan line (such as: y=1), the LCD display device 50 is operated in state 4 and the address calculation path is node 6→node 2→node 3→node 4→node 5. In this case, the data LUT(x, y) stored in the address look-up table memory 66 is firstly read out, and then the address mapping circuit 64 performs address mapping for the LUT(x, y) to generate a corresponding target address ADD_r4. The target address ADD_r4 can be derived as follows:

$$ADD_r4=LUT(x,y)=H(LUT(x,y-1)+n)=(n-1)-h(LUT(x,y-1)+n),\ n\leqq x<2n \qquad \text{Formula 33}$$

According to the embodiments in FIG. 8 to FIG. 10, when driving the LCD display device 50 to operate in different states with the forward/backward manners, the manners that the address mapping circuit 64 performs address mapping can be summarized as follows:

Corresponding to the forward driving manner:

state 1: ADD_f1=x, 0≦x<n — Formula 13 state 2: $ADD_f2=h(x-n),\ n\leqq x<2n$ — Formula 14 state 3: $ADD_f3=LUT(x,y),\ 0\leqq x<n$ — Formula 15 state 4: $ADD_f4=h(LUT(x,y-1)+n),\ n\leqq x<2n$ — Formula 19

Corresponding to the backward driving manner:

state 1: ADD_r1=x, 0≦x<n — Formula 29 state 2: $ADD_r2=(n-1)-h(x-n),\ n\leqq x<2n$ — Formula 30 state 3: $ADD_r3=LUT(x,y),\ 0\leqq x<n$ — Formula 31 state 4: $ADD_r4=(n-1)-h(LUT(x,y-1)+n),\ n\leqq x<2n$ — Formula 33

Therefore, the present invention can generate the target addresses for accessing the row buffer memory 68 according to the different operation states of the LCD display device 50, and can utilize the address mapping circuit 64 and the address look-up table memory 66 for updating the target addresses, so that the row buffer memory 68 with a large capacity is not needed to be used.

Those skilled in the art will readily observe that numerous modifications and alterations of the device and method may be made while retaining the teachings of the invention.

What is claimed is:

1. A method for driving a display device, the display device comprising an address counter, an address mapping circuit, an address look-up table memory, and a row buffer memory, the method comprising:

generating a plurality of address variables with the address counter according to a plurality of data numbers of a scan line of a plurality of scan lines on the display device;

address mapping the address variable generated by the address counter with the address mapping circuit to generate a corresponding first target address;

address mapping data stored in the address look-up table memory according to the address variables generated by the address counter to generate a corresponding second target address;

writing a first half of input data of a first scan line into the row buffer memory according to the address variables generated by the address counter in a first state;

reading a first half of output data of the first scan line from the row buffer memory according to the first target address generated by the address mapping circuit in a second state;

writing a first half of input data of a second scan line into the row buffer memory according to the second target address generated by the address look-up table memory in a third state; and reading output data of the second scan line from the row buffer memory according to a third target address generated by the address mapping circuit in a fourth state.

2. The method of claim 1 further comprising:

storing the first target address, the second target address and the address variables into the address look-up table memory.

3. The method of claim 1, wherein the address counter generates corresponding 2n address variables according to the first scan line including 2n bytes.

4. The method of claim 3 further comprising:

subtracting n from the address variable of the 2n address variables to generate a corresponding parameter with the address mapping circuit when the address variable is between n and 2n;

right shifting the parameter (m+1) bits to generate the first target address when all of the m least significant bits of the parameter represented in binary form are 1 and the $(m+1)^{th}$ least significant bit is 0; and right shifting the parameter 1 bit to generate the first target address when the least significant bit of the parameter represented in binary form is 0.

5. The method of claim 4 further comprising:

determining a value of the least significant bit when the parameter is represented in binary form.

6. The method of claim 3 further comprising:

reading out data stored in the address look-up table memory corresponding to the first scan line and the address variable of the 2n address variables, and subtracting n from the data to generate a corresponding parameter when the address variable is between n and 2n;

right shifting the parameter (m+1) bits to generate the first target address when all of the m least significant bits of the parameter represented in binary form are 1 and the $(m+1)^{th}$ least significant bit is 0; and right shifting the parameter 1 bit to generate the first target address when the least significant bit of the parameter represented in binary form is 0.

7. The method of claim 6 further comprising:

determining a value of the least significant bit when the parameter is represented in binary form.

8. The method of claim 3 further comprising:

subtracting n from the address variable of the 2n address variables to generate a corresponding parameter with the address mapping circuit when the address variable is between n and 2n;

right shifting the parameter (m+1) bits to generate a first value, adding 1 to the first value to generate a second value and subtracting the second value from the address variable to generate the first target address when all of the m least significant bits of the parameter represented in binary form are 1 and the $(m+1)^{th}$ least significant bit is 0; and right shifting the parameter 1 bit to generate a third value, adding 1 to the third value to generate a fourth value and subtracting the fourth value from the address variable to generate the first target address when the least significant bit of the parameter represented in binary form is 0.

9. The method of claim 8 further comprising:

determining a value of the least significant bit when the parameter is represented in binary form.

10. The method of claim 3 further comprising:

reading out data stored in the address look-up table memory corresponding to the first scan line and the address variable of the 2n address variables, and subtracting n from the data to generate a corresponding parameter when the address variable is between n and 2n;

right shifting the parameter (m+1) bits to generate a first value, adding 1 to the first value to generate a second value and subtracting the second value from the address variable to generate the first target address when all of the m least significant bits of the parameter represented in binary form are 1 and the $(m+1)^{th}$ least significant bit is 0; and right shifting the parameter 1 bit to generate a third value, adding 1 to the third value to generate a fourth value and subtracting the fourth value from the address variable to generate the first target address when the least significant bit of the parameter represented in binary form is 0.

11. The method of claim 10 further comprising:

determining a value of the least significant bit when the parameter is represented in binary form.

12. The method of claim 1 further comprising:

outputting data corresponding to the first and the second scan line from the row buffer memory to the display device.

13. The method of claim 1 further comprising:

generating data corresponding to the first and the second scan line.

* * * * *